US010728659B2

(12) United States Patent
Putzeys et al.

(10) Patent No.: US 10,728,659 B2
(45) Date of Patent: Jul. 28, 2020

(54) METHOD OF CONTROLLING LOUDSPEAKER DIAPHRAGM EXCURSION

(71) Applicant: Purifi APS, Hojbjerg (DK)

(72) Inventors: Bruno Putzeys, Rotselaar (NL); Lars Risbo, Hvalso (DK)

(73) Assignee: Purifi APS, Hojbjerg (DK)

( * ) Notice: Subject to any disclaimer, the term of this patent is extended or adjusted under 35 U.S.C. 154(b) by 0 days.

(21) Appl. No.: 16/097,991

(22) PCT Filed: May 2, 2017

(86) PCT No.: PCT/EP2017/060347
§ 371 (c)(1),
(2) Date: Oct. 31, 2018

(87) PCT Pub. No.: WO2017/191097
PCT Pub. Date: Nov. 9, 2017

(65) Prior Publication Data

US 2019/0149920 A1 May 16, 2019

(30) Foreign Application Priority Data

May 2, 2016 (EP) ..... 16167904

(51) Int. Cl.
*H04R 3/00* (2006.01)
*H04R 29/00* (2006.01)
*H04R 3/06* (2006.01)

(52) U.S. Cl.
CPC ..... *H04R 3/007* (2013.01); *H04R 3/06* (2013.01); *H04R 29/003* (2013.01)

(58) Field of Classification Search
CPC ..... H04R 29/003; H04R 3/002; H04R 3/007; H04R 3/02
USPC ..... 381/55, 96
See application file for complete search history.

(56) References Cited

U.S. PATENT DOCUMENTS

| | | | | |
|---|---|---|---|---|
| 4,327,250 | A | 4/1982 | von Recklinghausen | |
| 5,528,695 | A | 6/1996 | Klippel | |
| 2005/0207584 | A1 | 9/2005 | Bright | |
| 2009/0268918 | A1* | 10/2009 | Solgaard | H03G 9/005 381/55 |

(Continued)

OTHER PUBLICATIONS

International Search Report (PCT/ISA/210) for PCT/EP2017/060347 dated Jul. 3, 2017.

(Continued)

*Primary Examiner* — George C Monikang
(74) *Attorney, Agent, or Firm* — McHale & Slavin, P.A.

(57) ABSTRACT

The present invention relates in one aspect to a method of controlling or limiting diaphragm excursion of a loudspeaker. The method comprising steps of receiving a first audio signal and deriving an excursion signal representing diaphragm excursion of the electrodynamic loudspeaker from the first audio signal. The method additionally comprises deriving an excursion envelope from the excursion signal and applying a second audio signal, derived from the first audio signal, to an input of an adjustable low-frequency suppressor. The second audio signal is filtered by the adjustable low-frequency suppressor to selectively attenuate low-frequency components based on the excursion envelope to produce a processed audio signal with reduced low-frequency content.

17 Claims, 8 Drawing Sheets

(56) References Cited

U.S. PATENT DOCUMENTS

| | | | | |
|---|---|---|---|---|
| 2014/0241536 | A1* | 8/2014 | Adams | H04R 29/003 381/59 |
| 2015/0010170 | A1* | 1/2015 | Lindahl | H03H 17/0261 381/119 |

OTHER PUBLICATIONS

Written Opinion (PCT/ISA/237) of PCT/EP2017/060347 dated Jul. 3, 2017.

* cited by examiner

METHOD OF CONTROLLING LOUDSPEAKER DIAPHRAGM EXCURSION

CROSS-REFERENCE TO RELATED APPLICATIONS

This application is a national phase under 35 U.S.C. § 371 of PCT International Application No. PCT/EP2017/060347 which has an international filing date of May 2, 2017, and claims priority to European Patent Application No. 16167904.8, filed May 2, 2016, the entire contents of each of which are incorporated by reference.

The present invention relates in one aspect to a method of controlling or limiting diaphragm excursion of a loudspeaker. The method comprising steps of receiving a first audio signal and deriving an excursion signal representing diaphragm excursion of the electrodynamic loudspeaker from the first audio signal. The method additionally comprises deriving an excursion envelope from the excursion signal and applying a second audio signal, derived from the first audio signal, to an input of an adjustable low-frequency suppressor. The second audio signal is filtered by the adjustable low-frequency suppressor to selectively attenuate low-frequency components based on the excursion envelope to produce a processed audio signal with reduced low-frequency content.

BACKGROUND OF THE INVENTION

The present invention relates to a method of controlling and/or limiting diaphragm excursion or displacement of loudspeakers and a corresponding loudspeaker excursion controller. Methodologies, devices and systems for controlling diaphragm excursion of electrodynamic loudspeakers are highly useful for numerous purposes for example in connection with diaphragm excursion limitation. A sealed box direct radiator loudspeaker produces a sound pressure level which is proportional to an acceleration of the diaphragm or membrane such that the diaphragm excursion is the 2nd order integral of the sound pressure, e.g. representing a recorded audio signal like speech and music. Consequently, reproduction of low frequency sound pressure requires large diaphragm excursions. The resulting excursion requirement of the diaphragm can exceed the safe operating range of the loudspeaker under numerous circumstances—for example when the loudspeaker is driven by a powerful amplifier and operating at a high playback volume. In the latter situation, the power amplifier may drive the diaphragm and voice coil assembly beyond its maximum excursion limit leading to various kinds of irreversible mechanical damage.

In this case, it is desirable to reduce a level or power of the low-frequency components of the incoming audio signal before application to the loudspeaker while preserving a level or power of the incoming audio signal at higher frequencies in such a way that the maximum excursion limit of the loudspeaker is not exceeded. In connection with the control of the diaphragm excursion it is often of significant importance to maintain the perceptual quality of the reproduced sound of the loudspeaker, i.e. minimizing the audible impact of any dynamic adjustment of the audio reproduction signal path connected to the loudspeaker.

The proper control and limitation of diaphragm excursion are of significant importance in numerous sound reproduction applications such as high power loudspeakers for public address systems, automotive speakers and home Hi-Fi applications as well as miniature loudspeakers for portable communication devices such as smartphones, laptop computers etc.

SUMMARY OF THE INVENTION

A first aspect of the invention relates to a method of controlling or limiting diaphragm excursion of a loudspeaker, comprising steps of:

receiving a first audio signal, deriving an excursion signal representing diaphragm excursion of the electrodynamic loudspeaker from the first audio signal, deriving an excursion envelope from the excursion signal, applying a second audio signal, derived from the first audio signal, to an input of an adjustable low-frequency suppressor, filtering the second audio signal to selectively attenuate low-frequency components based on the excursion envelope to produce a processed audio signal with reduced low-frequency content.

The present method of limiting the diaphragm excursion of a loudspeaker may use the adjustable frequency response of the adjustable low-frequency suppressor to modify an audio signal path through the below-described diaphragm excursion limiter in a gentle and minimally audible way.

The first audio signal may comprise speech and/or music supplied from a suitable audio source such as radio, CD player, network player, MP3 player. The audio source may also comprise a microphone of a portable communication device e.g. a smartphone or mobile phone generating a real-time microphone signal in response to incoming sound. The first audio signal may comprise a digital audio signal or an analog audio signal. The digital audio signal may be formatted according to a standardized wireless or wired data communication protocol such as HDMI, Bluetooth, WLAN, Airplay, $I^2C$ or SPI. Alternatively, the digital audio signal may be formatted according to a standard digital audio protocol such as $I^2S$, SPDIF etc. When the first audio signal comprises the digital audio, all processing steps of the present methodology of controlling or limiting diaphragm excursion may be carried out by digital processing of digital signals. The same applies for the signals and functions of the diaphragm excursion limiter described below.

The selective attenuation of the low-frequency components of the second audio signal may be accomplished by relatively attenuating exclusively a low-frequency band of the second audio signal for example a frequency band below 500 Hz, 200 Hz or 100 Hz while leaving the residual (upper) audio frequency range substantially unattenuated. This attenuation of the low-frequency band is often very effective for mechanical protection purposes because low-frequency components of the audio signal are most likely to drive the loudspeaker diaphragm outside the excursion limit.

The skilled person will understand that the adjustable low-frequency suppressor may comprises various types of frequency-selective analog or digital filters such as an adjustable high-pass filter, band-reject or bandpass filter with appropriately adapted cut-off frequency or cut-frequencies.

The selective attenuation of the low-frequency components of the second audio signal is preferably controlled not to be overly conservative so that the available excursion headroom of the controlled loudspeaker is utilized fully without being exceeded. This feature prevents that the maximum sound pressure capability of the connected or controller loudspeaker is not unduly restricted.

One embodiment of the present methodology of controlling the diaphragm excursion comprises further steps of:

applying the excursion signal to the input of the adjustable low-frequency attenuator, converting the processed audio signal into a corresponding audio voltage signal, amplifying or buffering the audio voltage signal for application to the electrodynamic loudspeaker.

In this embodiment, the excursion signal is applied to an input of the adjustable low-frequency attenuator. The conversion of the processed audio signal into the corresponding audio voltage or amplitude signal may be carried out by an inverse excursion estimator. The skilled person will understand that the inverse excursion estimator may possess a transfer function which is an inverse of a transfer function of an excursion estimator configured to derive the excursion signal. In this manner, the combined effect of a series connection of the excursion estimator and the inverse excursion estimator can be viewed as a linear time-invariant filter with a substantially flat frequency response such as an all-pass filter. This embodiment of the present methodology operates in an excursion domain instead of the more ordinary voltage or amplitude domain as discussed in additional detail below with reference to the appended drawings.

One embodiment of the present methodology of controlling the diaphragm excursion comprises further steps of:

delaying the first audio signal with a predetermined time delay, such as between 5 ms and 50 ms, to produce the second audio signal, amplifying or buffering the processed audio signal for application to the loudspeaker.

The addition of the predetermined time delay to the second audio signal may be advantageous to properly align a time delay through an audio signal path of the diaphragm excursion limiter to a time delay through a control path of the diaphragm excursion limiter as discussed in additional detail below with reference to the appended drawings.

One embodiment of the present methodology of controlling the diaphragm excursion comprises further steps of:

comparing the excursion envelope to an excursion threshold representing a predetermined excursion value of the diaphragm, e.g. a maximum diaphragm excursion; and if, or when, the excursion envelope is smaller than the excursion threshold: maintain a substantially stationary response of the adjustable low-frequency suppressor. If the excursion envelope on the other hand is larger than, and possibly equal to, the excursion threshold, the second audio signal may be processed to selectively increase the attenuation of the low-frequency components of the audio signal with increasing magnitude of the excursion envelope following a certain predetermined relationship as discussed in additional detail below. This embodiment may lead to a substantially stationary frequency response of the adjustable low-frequency suppressor for audio signal levels below the excursion threshold which is helpful to eliminate or suppress unwanted amplitude modulation or "pumping" effects of the processed audio signal.

Another embodiment of the present methodology comprises further steps of:

deriving an acceleration envelope, representing diaphragm acceleration of the electrodynamic loudspeaker, from the excursion signal or the excursion envelope, filtering the second audio signal in accordance with the acceleration envelope. The acceleration envelope may be derived from the excursion envelope by 2nd order differentiation—for example carried out by an appropriately configured highpass filter with a frequency response approximating a response of a 2nd order differentiator within a target frequency band or range as discussed in additional detail below with reference to the appended drawings. The acceleration envelope may be utilized to determine the processing of the second audio signal when the excursion envelope is larger than, and possibly equal to, the excursion threshold. In certain embodiments, the acceleration envelope only is utilized to determine the processing of the second audio signal. The second audio signal may be processed to selectively increase the attenuation of the low-frequency components of the audio signal with increasing magnitude of the acceleration envelope in accordance with a certain predetermined relationship as discussed in additional detail below.

An alternative embodiment of the present methodology exploits an instantaneous frequency of the first audio signal, or an audio signal derived therefrom such as the excursion signal, instead of the acceleration envelope to control the processing of the second audio signal. This alternative embodiment comprises further steps of:

determining the instantaneous frequency of the first audio signal and filtering the second audio signal in accordance with the instantaneous frequency.

According to one such embodiment, a cut-off frequency fc of an adjustable low-frequency suppressor, e.g. an adjustable high-pass filter, filtering the second audio signal is determined according to:

$$f_c = \sqrt{\frac{x_{env}}{X_{th}}} * f_{inst}$$

wherein:

$f_{inst}$ represents the instantaneous frequency of the audio signal;

x_env represents the instantaneous excursion envelope;

$X_{th}$ represents the excursion threshold.

The instantaneous frequency of the first audio signal may be determined by estimating or computing a Hilbert transform of the first audio signal or of the excursion signal. Hence, the Hilbert transform computation may be helpful to simultaneously provide the excursion envelope and the instantaneous frequency.

Other embodiments of the present methodology may exploit a combination of the instantaneous frequency of the first audio signal and the acceleration envelope to control the processing of the second audio signal.

One embodiment of the adjustable low-frequency suppressor comprises an adjustable high-pass filter with an adjustable cut-off frequency. The adjustable high-pass filter may comprise a first order, second order or even higher order high-pass filter. Some embodiments of the adjustable high-pass filter may have a fixed minimum setting when the excursion envelope is smaller than the excursion threshold such that the present methodology of controlling the diaphragm excursion comprises further steps of:

setting the cut-off frequency of the adjustable high-pass filter to a predetermined minimum setting when the excursion envelope is smaller than the excursion threshold. This predetermined minimum setting of the cut-off frequency may be smaller than 50 Hz, or 20 Hz or 10 Hz and will generally depend on characteristics of a particular loudspeaker under control and other requirements of the application.

The adjustable high-pass filter may comprise a digital filter for example an IIR filter or FIR filter configured to filtering the second audio signal in the time-domain. An architecture of the digital filter may be chosen such that a momentary change of the cut-off frequency produces minimal momentary changes of the processed output signal of the digital filter thereby acting to minimize audible artefacts induced by the dynamic adjustment or change of the cut-off frequency. One embodiment of the digital filter comprises a state-space representation of a 2nd order LCR continuous-time high-pass filter. The filter inductance L and the filter capacitance C are both inversely proportional to the selected cut-off frequency. The states of the state-space filter may comprise digital integrators representing the capacitor voltage and inductor current such that a change of cut-off frequency appears only as multiplications at an input side of each of the digital integrators. Consequently, the outputs of the digital integrators will change relatively smoothly in response to an abrupt change of cut-off frequency.

According to one embodiment, the present methodology comprises further steps of:

increasing the cut-off frequency of the adjustable high-pass filter in response to increasing magnitude of the acceleration envelope when the excursion envelope exceeds the excursion threshold. The cut-off frequency of the adjustable high-pass filter may be increased from the predetermined minimum setting of the cut-off frequency to a maximum setting which is two, three or more octaves higher than the minimum setting. The cut-off frequency of the adjustable high-pass filter may for example be increasing monotonically with increasing magnitude of the acceleration envelope.

Certain embodiments of the present method may determine the cut-off frequency, fc, of the adjustable high-pass filter according to:

$$f_c = \sqrt{\frac{A_{acc}}{X_{th}}}$$

wherein:

$A_{acc}$ represents the instantaneous acceleration envelope;

$X_{th}$ represents the excursion threshold.

This embodiment may be particularly well-suited for adjusting the cut-off frequency setting of 2nd order high-pass filters since the diaphragm acceleration to diaphragm displacement function may exhibit a very high compression ratio through the target frequency range. In other words, the cut-off frequency of the adjustable high-pass filter may be increased at a rate such that the diaphragm excursion is kept substantially constant for increasing magnitude of the acceleration envelope in response to the excursion envelope exceeds the excursion threshold as discussed in further detail below with reference to the appended drawings.

The step of determining the excursion envelope of the excursion signal may comprise determining a Hilbert transform of the excursion signal according to some embodiments of the present methodology as discussed in additional detail below with reference to the appended drawings. The determination of the Hilbert transform of the excursion signal may comprise filtering the excursion signal with a first all-pass filter exhibiting a first phase response and filtering the excursion signal with a second all-pass filter exhibiting a second phase response. The first and second all-pass filters exhibit a mutual phase difference of substantially 90 degrees over a predetermined frequency range of the audio signal such as the above-discussed low-frequency band or between the previously discussed minimum and maximum settings of the cut-off frequency of the adjustable high-pass filter.

The first all-pass filter may comprise a 2nd order IIR filter and the second all-pass filter may also comprise a 2nd order IIR filter as discussed in additional detail below with reference to the appended drawings.

The steps of deriving the acceleration envelope may be carried out in various ways by processing of the first audio signal, the excursion signal or the excursion envelope. One embodiment comprises steps of:

filtering the excursion envelope by a 2nd order highpass filter possessing a predetermined highpass cut-off frequency;

said predetermined highpass cut-off frequency being situated at or above a maximum cut-off frequency of the adjustable high-pass filter as discussed in additional detail below with reference to the appended drawings.

A second aspect of the invention relates to a diaphragm excursion limiter or controller for a loudspeaker. The diaphragm excursion limiter comprising an audio signal path extending between an audio input and an audio output. The audio input is configured for receipt of a first audio signal. The audio signal path preferably comprises at least an adjustable low-frequency suppressor for receipt and filtering of a second audio signal, derived from the first audio signal. The diaphragm excursion limiter additionally comprises:

an excursion estimator configured for determining an excursion signal, representing diaphragm excursion of the loudspeaker, based on the first audio signal, a first envelope detector configured for determining an excursion envelope of the excursion signal, a controller configured to adjust a frequency response of the adjustable low-frequency suppressor based on an excursion envelope to selectively suppress low-frequency components of the second audio signal in a processed audio signal at an output of the adjustable low-frequency suppressor.

The skilled person will appreciate that the controller may comprise a programmable microprocessor or signal processor controllable by an application program comprising a set of executable program instructions stored in a program memory. The programmable microprocessor may comprise a software programmable DSP integrated on, or operatively coupled to, the excursion limiter.

The skilled person will understand that the application program may carry out one or more of the previously discussed steps of the present methodology of controlling the diaphragm excursion when executed on the microprocessor. The audio signal path of the diaphragm excursion limiter may comprise various additional components or circuits such as a power amplifier for receipt of the processed audio signal and generation of an amplified or buffered processed audio signal for application to the loudspeaker.

The diaphragm excursion limiter may further comprise a second envelope detector configured for determining an acceleration envelope, representing diaphragm acceleration of the loudspeaker, based on the excursion signal; and the controller being configured to adjust the frequency response of the adjustable low-frequency suppressor in accordance with an excursion signal and the acceleration envelope. The role of the acceleration envelope in the adjustment of the adjustable low-frequency suppressor has been discussed in detail above.

The controller may comprise comparator configured to compare the excursion envelope to an excursion threshold representing a predetermined excursion value of the diaphragm, e.g. a maximum diaphragm excursion;

the controller being configured to:

if the excursion envelope is smaller than the excursion threshold, maintaining a substantially stationary frequency response of the adjustable low-frequency suppressor;

if the excursion envelope exceeds the excursion threshold, adjusting the frequency response of the adjustable low-frequency suppressor to increase attenuation of the low-frequency components of the second audio signal for increasing acceleration envelope. The controller may be adapted to operate on digital audio and control signals such as digitized representations of the first audio signal, predetermined excursion value, excursion envelope, acceleration envelope etc.

A third aspect of the invention relates to a diaphragm excursion control system comprising a diaphragm excursion limiter according to any of the above described embodiments thereof and a loudspeaker. The loudspeaker is operatively connected to the processed audio signal supplied by the diaphragm excursion limiter for diaphragm excursion or displacement limitation. The processed audio signal may be supplied to the controlled loudspeaker through a power amplifier of the diaphragm excursion limiter.

BRIEF DESCRIPTION OF THE DRAWINGS

Preferred embodiments of the invention will be described in more detail in connection with the appended drawings, in which.

DETAILED DESCRIPTION OF PREFERRED EMBODIMENTS

Figure 1:
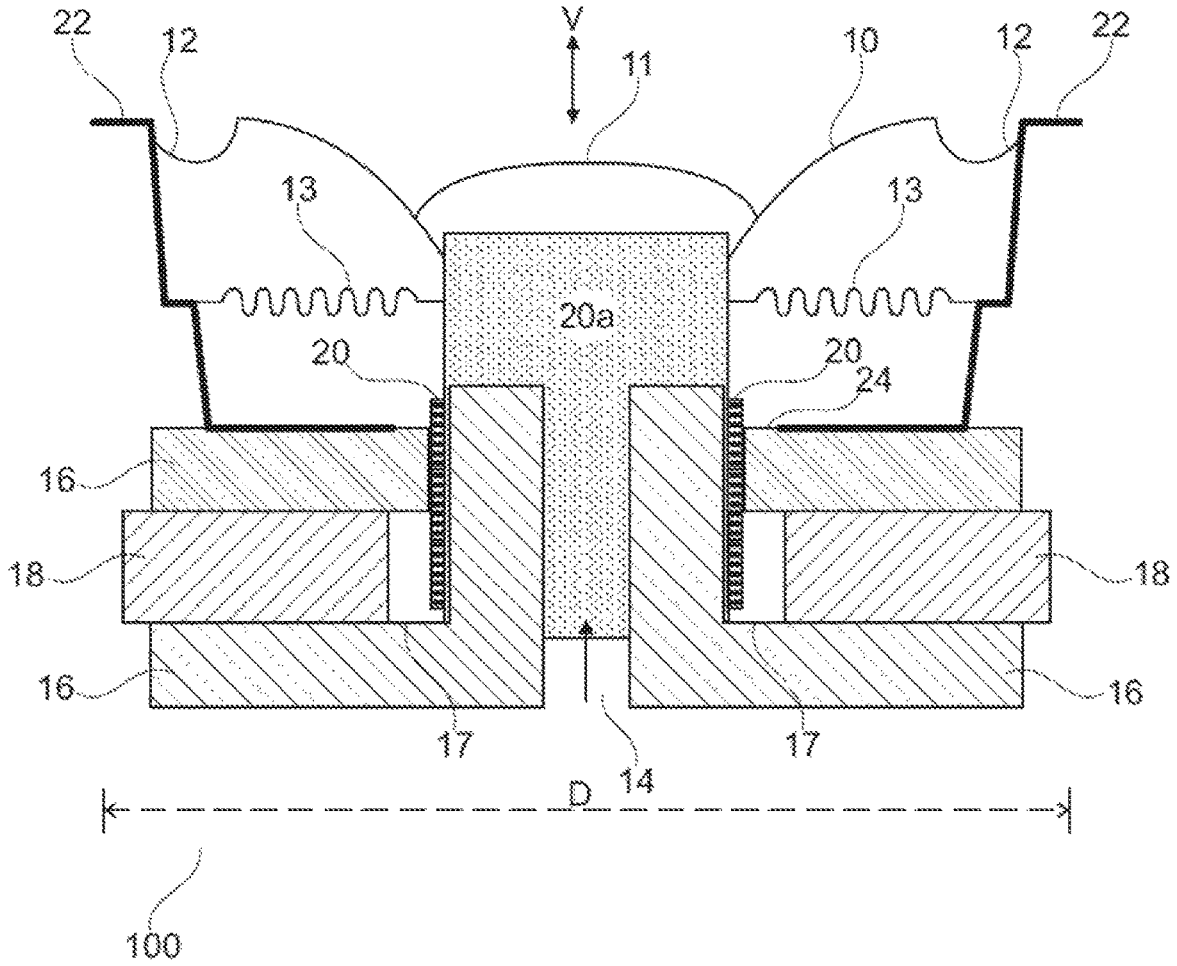
FIG. 1 is a schematic cross-sectional view of an exemplary electrodynamic loudspeaker suitable for connection to various embodiments of the present diaphragm excursion limiter.

FIG. 1 is a schematic illustration of an exemplary electrodynamic loudspeaker 100 for application together with various embodiments of the present invention. The skilled person will appreciate that loudspeakers for sound reproduction exist in numerous types, shapes and sizes dependent on the targeted kind of application. The electrodynamic loudspeaker 100 used in the below described methodologies and devices for loudspeaker excursion control and limitation may have a diaphragm diameter, D, of approximately 5-10 inches. However, the skilled person will appreciate that the present invention is applicable to virtually all types of loudspeakers for example electrostatic speakers and electrodynamic loudspeakers, in particular miniature electrodynamic loudspeakers for sound reproduction in portable terminals such as mobile phones, smartphones and other portable music playing equipment. The maximum outer dimension D of such miniature electrodynamic loudspeakers may lie between 6 mm and 30 mm.

The electrodynamic loudspeaker 100 comprises a diaphragm 10 fastened to a voice coil former 20*a*. A voice coil 20 is wound around the voice coil former 20*a* and rigidly attached thereto. The diaphragm 10 is also mechanically coupled to a speaker frame 22 through a resilient edge or outer suspension 12. An annular permanent magnet structure 18 generates a magnetic flux which is conducted through a magnetically permeable structure 16 having a circular air gap 24 arranged therein. A circular ventilation duct 14 is arranged in a center of the magnetically permeable structure 16. The duct 14 may be used to conduct heat away from an otherwise sealed chamber situated beneath the diaphragm 10 and dust cap 11. A flexible inner suspension 13 is also attached to the voice coil former 20*a*. The flexible inner suspension 13 serves to align or center the position of the voice coil 20 in the air gap 24. The flexible inner suspension 13 and resilient edge suspension 12 cooperate to provide relatively well-defined compliance of the movable diaphragm assembly (voice coil 20, voice coil former 20*a* and diaphragm 10). Each of the flexible inner suspension 13 and resilient edge suspension 12 may be designed to limit maximum excursion or maximum excursion of the movable diaphragm assembly.

During operation of the loudspeaker 100, a drive signal voltage or drive current is applied to the voice coil 20 of the loudspeaker 100. A corresponding voice coil current is induced in response leading to essentially uniform vibratory motion and reciprocating excursion or displacement, in a piston range of the loudspeaker, of the diaphragm assembly in the direction indicated by the velocity arrow V. Thereby, a corresponding sound pressure is generated by the loudspeaker 100. The vibratory motion of the voice coil 20 and diaphragm 10 in response to the flow of voice coil current is caused by the presence of a radially-oriented magnetic field in the air gap 24. The application of excessively large voice coil currents which force the movable diaphragm assembly beyond its maximum allowable excursion or excursion limit is a common fault mechanism in electrodynamic loudspeakers leading to various kinds of irreversible mechanical damage. One type of mechanical damage may for example be caused by collision between the lowermost edge of the voice coil 20 and an annular facing portion 17 of the magnetically permeable structure 16.

Figure 2:
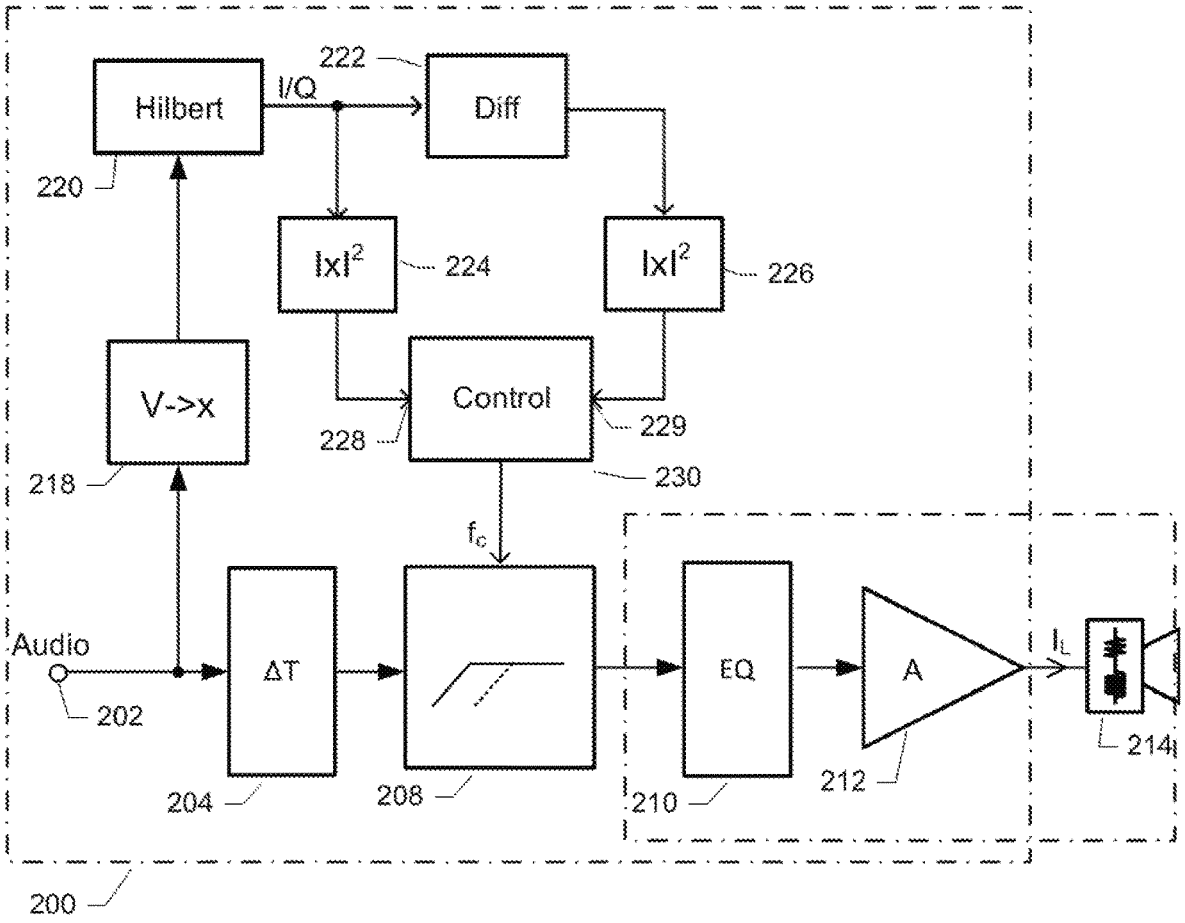
FIG. 2 shows a simplified schematic block diagram of a diaphragm excursion limiter in accordance with a first embodiment of the invention.

FIG. 2 shows a simplified schematic block diagram of a diaphragm excursion limiter 200 in accordance with a first embodiment of the invention. The diaphragm excursion limiter 200 comprises an audio signal path extending between an audio input 202 and an audio output 216. The audio input 202 is configured for receipt of an incoming/input audio signal from various types of audio signal sources. The audio signal path comprises a cascade of interconnected processing functions or circuits between the audio input 202 and the audio output 216. The audio signal path comprises a cascade of interconnected processing functions such as a time delay function or circuit 204, an adjustable low-frequency suppressor 208, e.g. comprising an adjustable high-pass filter, an optional equalizer function or circuit 210 and a power or output amplifier 212. The output of the power amplifier forms the audio output 216 and may be connected to a loudspeaker 214 such as the above-discussed exemplary electrodynamic loudspeaker 100.

The diaphragm excursion limiter 200 additionally comprises a control path, or side-chain path, that is configured to adaptively or dynamically control and set a cut-off frequency fc of the adjustable high-pass filter 208. The control path comprises an excursion estimator 218 configured for determining an excursion signal representing diaphragm excursion of the loudspeaker based on the incoming first audio signal at input 202. The characteristics of the excursion estimator 218 for generating or deriving the excursion signal may in some embodiments of the invention be determined based on a priori knowledge of the respective transfer functions of the adjustable high-pass filter 208, the equalizer function 210, the power or output amplifier 212 and the loudspeaker 214. The transfer function of the latter signal or audio path may be represented by an input voltage, at audio input 202, to excursion transfer function. The latter may have been experimentally measured or computed prior to the activation, manufacturing or customization of the diaphragm excursion limiter 200. The time delay function 204 in front of the adjustable high-pass filter 208 is advantageous to properly align a time delay through the audio signal path, extending through the adjustable high-pass filter 208 and power amplifier 212, with a time delay through the control path.

The lacking need for a real-time sensor to sense motion of the loudspeaker diaphragm may represent a significant advantage of this embodiment of the excursion estimator 218 in numerous applications. Alternatively, the excursion estimator 218 may derive the excursion signal from a motion sensor, such as an accelerometer or velocity or displacement sensor, mounted on or at the loudspeaker diaphragm. A first envelope detector is configured for determining an excursion envelope of the excursion signal. The first envelope detector may comprise a Hilbert transform estimator 220 supplying the excursion envelope as a complex output signal (I/Q signals, a.k.a. analytical signal) which has a magnitude equal to the envelope of the excursion signal as discussed in further detail below. The first envelope detector additionally comprises a first magnitude estimator 224 which computes a square of the excursion envelope and applies the resulting magnitude signal or variable to a first input of a control circuit or function 230.

The control path additionally comprises a 2nd order differentiator 222 configured to derive or determine an acceleration envelope, representing diaphragm acceleration of the electrodynamic loudspeaker 214, from the complex excursion signal. The 2nd order differentiator 222 approximates or mimics the functionality of a double differentiator at least throughout the frequency range or frequency band of interest. The operation of the 2nd order differentiator 222 converts the complex excursion signal (I/Q) into a corresponding vector signal representing the acceleration of the diaphragm. The frequency range of interest for the present diaphragm excursion limiter embodiment may extend from 5 Hz to 200 Hz for example from 10 Hz to 100 Hz. The skilled person will understand that the frequency range of interest, i.e. target frequency band may vary considerably depending on various factors such as properties of the electrodynamic loudspeaker 214. One embodiment of the 2nd order differentiator 222 comprises a 2nd order high-pass filter with corner/cut-off frequency set at or slightly above the highest frequency of the target frequency band for example at 100 Hz or 200 Hz. These settings of the corner/cut-off frequency of the 2nd order high-pass filter of the differentiator 222 makes the diaphragm excursion limiter 200 less prone to overreacting to large high-frequency bursts of the audio input signal where high-frequency means frequencies above the target frequency band. The latter is typically located at relatively low frequencies of the audio spectrum as discussed above. A second magnitude estimator 226 computes/determines a square of the acceleration envelope and applies the resulting squared magnitude acceleration signal to a second input 229 of the control function 230. The control function 230 or controller is responsive to both the acceleration envelope at the second input 229 and the excursion envelope at the first input 228 to determine the cut-off frequency $f_c$ of the adjustable high-pass filter 208 in the present embodiment of the diaphragm excursion limiter 200 as discussed in additional detail below with reference to FIG. 3.

The limitation of the diaphragm excursion of the loudspeaker 214 is effected by the variable or adaptive frequency response characteristics of the adjustable high-pass filter 208. The adjustable high-pass filter 208 may act as a linear but time-varying filter. The adjustable high-pass filter 208 filters the applied audio signal at the input of the filter 208 with its instantaneous frequency response such that low-frequency components of the applied audio signal are selectively suppressed or attenuated, in a varying amount, in a processed audio signal at an output of the filter 208. The attenuated low-frequency components are preferably components within the previously discussed target frequency band for example between 5 Hz and 200 Hz where the diaphragm displacement has the largest value for typical loudspeaker constructions such as closed-box direct radiator loudspeakers. In contrast higher frequency components of the applied audio signal may be passed through the filter 208 substantially unattenuated such that any negative impact on the perceived sound quality and loudness of the processed audio signal at the output 216 is minimized. The adjustable high-pass filter 208 therefore acts as a time-varying linear filter with an instantaneous frequency response determined by the controller 230.

Figure 3:
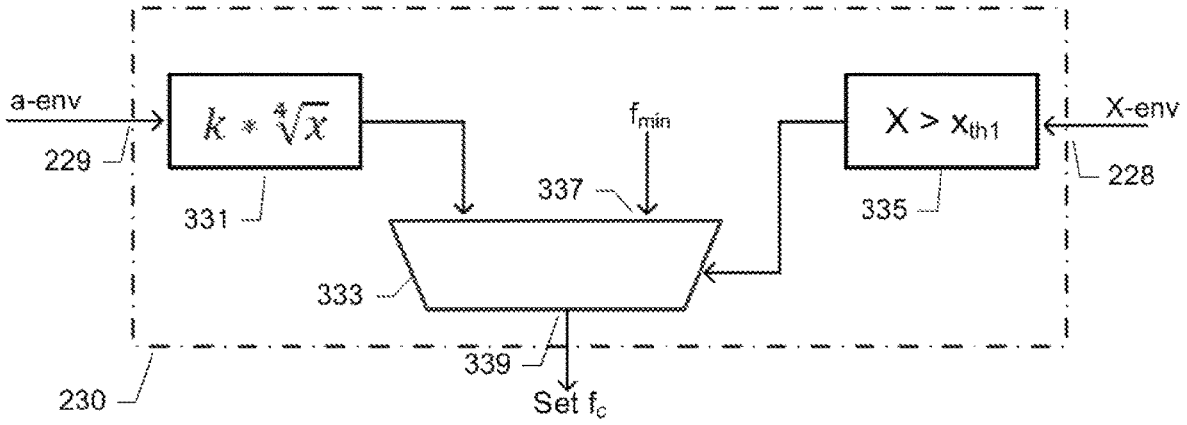
FIG. 3 shows a simplified schematic block diagram of a controller of the diaphragm excursion limiter.

FIG. 3 shows a simplified schematic block diagram of the controller 230. As previously mentioned, the controller is responsive to both the acceleration envelope and the excursion envelope for setting the instantaneous cut-off frequency $f_c$ of the adjustable high-pass filter 208 in the present embodiment. The skilled person will understand the controller 230 may be constructed by suitably configured combinatorial and sequential digital logic blocks or circuits or by a software programmable microprocessor on a combination of both. The controller 230 comprises the previously discussed first and second inputs 228, 229 at which the squared excursion envelope and the squared acceleration envelope are applied, respectively. The controller additional comprises a predetermined minimum setting $f_{min}$ of the cut-off frequency fc of the adjustable high-pass filter 208 as schematically indicated. This predetermined minimum setting $f_{min}$ may for example be stored in a non-volatile memory (not shown) of the controller 230 or elsewhere in the diaphragm excursion limiter 200 and accessible to the controller for reading. The controller 230 comprises a function 331 which computes a constant k times the square root of the acceleration envelope (i.e. the 4th root of the output of the first magnitude estimator 224 which is the squared acceleration envelope). The constant k may be selected to ensure that a worst case audio input signal will not exceed a selected excursion threshold. In some embodiments, the value of k may be derived mathematically from the below-discussed excursion threshold $X_{th}$ as:

$$k = \frac{1}{\sqrt{X_{th}}}$$

The value of the constant k may deviate slightly from this value for example to make the diaphragm excursion limiter more conservative leaving headroom for dynamic overshoots etc.

The scaled acceleration envelope is applied to a first multiplexer input of a multiplexer 333 while the predetermined minimum setting $f_{min}$ is applied to a second multiplexer input 337 of the multiplexer 333. A comparator 335 of the controller 230 is configured to comparing the excursion envelope to an excursion threshold th1. The excursion threshold th1 is representing a preselected or desired excursion value of the diaphragm. The excursion threshold th1 may for example be selected based on a priori knowledge of certain excursion characteristics and safe operating limits of the loudspeaker 100. The excursion threshold th1 may for example represent a maximum diaphragm excursion recommended by the loudspeaker manufacturer. An output of the comparator 335 is connected to a select input or terminal of the multiplexer 333 and thereby controls whether the predetermined minimum setting $f_{min}$ or the scaled acceleration envelope is conveyed to the output of the comparator 335 for setting the instantaneous fc value utilized by the adjustable high-pass filter 208. The controller may comprise an optional smoothing filter or integrator connected to an output 339 of the controller 230 to smooth the control signal for the instantaneous fc setting. This smoothing filter may have a time constant of about 5 ms to 50 ms for example between 10 ms and 20 ms. The time delay of the previously discussed delay function 204 may be increased to match the selected time constant of the smoothing filter.

Consequently, the overall effect of the operation of the controller 230 is to set the cut-off frequency fc of the adjustable high-pass filter 208 to the minimum setting $f_{min}$ when the excursion envelope is smaller than the excursion threshold th1. This feature results in a substantially stationary response of the adjustable high-pass filter 208 for small low-frequency levels of the audio input signal such as levels that will keep the diaphragm excursion of displacement well below the previously discussed safe operating limits of the loudspeaker 214. A selection of the minimum setting $f_{min}$ of the cut-off frequency fc may be based on various specific characteristics of the loudspeaker 100 and the intended application of the diaphragm excursion limiter 200. The minimum setting $f_{min}$ of the adjustable high-pass filter 208 may provide DC-blocking or low-frequency filtering that is required anyway in the audio signal path and hence does not represent any additional component cost. The minimum setting $f_{min}$ of the cut-off frequency fc may for example lie between 2 Hz and 100 Hz such as between 5 Hz and 20 Hz.

The stationary response of the adjustable high-pass filter 208 below the excursion threshold $X_{th1}$ has the advantage that unwanted amplitude modulation or "pumping" effects of the processed audio input signal may be largely eliminated. On the other hand in response to the excursion envelope exceeds the excursion threshold th1, the setting of the instantaneous fc value is controlled by the instantaneous acceleration envelope. The cut-off frequency fc of the adjustable high-pass filter 208 increases from the minimum setting $f_{min}$ for increasing magnitude or value of the acceleration envelope thereby limiting the excursion of the loudspeaker by increasing the selective attenuation of low-frequency signal components of the audio input signal. In this manner, the cut-off frequency fc of the adjustable high-pass filter 208 may track or follow the instantaneous acceleration envelope according to a certain function or relationship. The functional relationship between the cut-off frequency fc and the acceleration envelope may be determined by the controller 230. Certain embodiments of the controller 230 may be configured to adjust the cut-off frequency fc as a function of the acceleration envelope such that the diaphragm excursion remains essentially constant for increasing acceleration envelope above the excursion threshold $th_1$. This feature is described in additional detail below with reference to the signal plots.

In one embodiment of the controller 230, the cut-off frequency fc of the adjustable high-pass filter tracks the instantaneous acceleration envelope according to:

$$f_c = \sqrt{\frac{A_{acc}}{X_{th}}}$$

wherein:

$A_{acc}$ represents the instantaneous acceleration envelope;

$X_{th}$ represents the excursion threshold.

This embodiment is particularly helpful for application to closed-box direct radiator loudspeakers.

Figure 4:
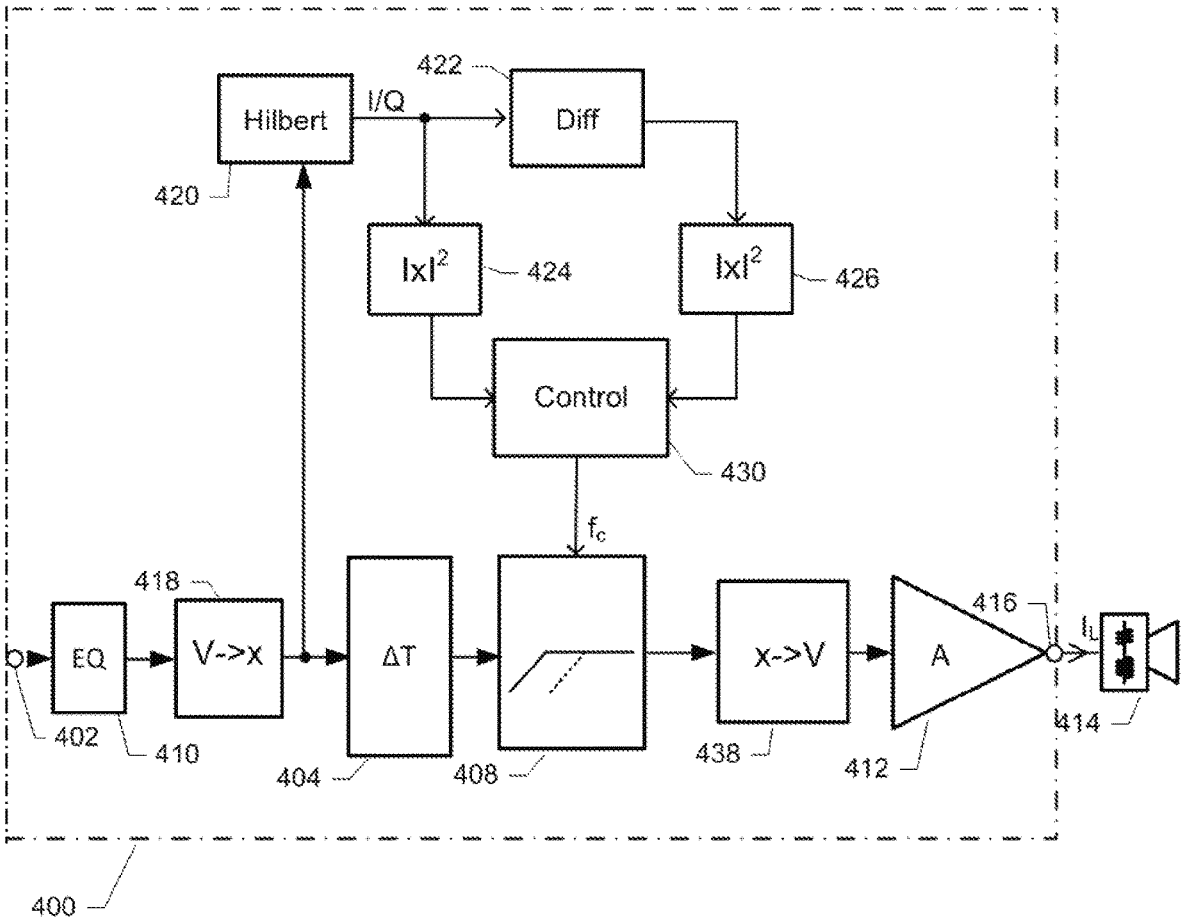
FIG. 4 shows a simplified schematic block diagram of a diaphragm excursion limiter in accordance with a second embodiment of the invention.

FIG. 4 shows a simplified schematic block diagram of a diaphragm excursion limiter 400 in accordance with a second embodiment of the invention. The diaphragm excursion limiter 400 has a different topology, including a modified audio signal path, compared to the first embodiment of the diaphragm excursion limiter 200 discussed above. However, the majority of signal processing functions and circuits are identical between these two embodiments and corresponding circuits and functions have been assigned with corresponding reference numerals to ease comparison. Hence, only significant functional and topology differences are discussed in the following.

The audio signal path of the diaphragm excursion limiter 400 extends between an audio input 402 and an audio output 416. The audio signal path comprises a cascade of interconnected processing functions such as an optional equalizer function or circuit 410, an excursion estimator 418, a time delay function or circuit 404, an adjustable low-frequency suppressor 408, e.g. comprising an adjustable high-pass filter, an inverse excursion estimator 438 and a power or output amplifier 412. The excursion estimator 418 is configured for determining an excursion signal representing diaphragm excursion of the loudspeaker 414 based directly on the incoming audio signal at input 402 or an equalized audio signal supplied at the output of the equalizer function 410. The operation of the diaphragm excursion estimator 418 may be identical to the previously discussed diaphragm excursion estimator 218. However, in contrast to the previously discussed excursion limiter 200, the excursion signal is applied to the input of the adjustable low-frequency suppressor 408 instead of the audio input signal at input 402. The excursion signal is time-delayed by the delay function 404. This feature means that the adjustable low-frequency suppressor 408 operates and applies the previously-discussed low-frequency suppression in an excursion domain rather than the ordinary signal voltage/amplitude domain of the audio signal. This domain change is a consequence of the different position of the excursion estimator 418 in the topology of the diaphragm excursion limiter 400 compared to the previous embodiment 200. Hence, the processed output signal generated by the adjustable low-frequency suppressor 408 is also in the excursion domain and must be converted back to the proper signal voltage/amplitude domain of the audio signal before application to the loudspeaker 414 through the power amplifier 412. This conversion process is carried out by the inverse excursion estimator 438. The skilled person will understand that the inverse excursion estimator 438 may possess a transfer function which is inverse of a transfer function of the excursion estimator 418 such that the combined effect of the cascade of these functions 418, 438 can be viewed as a linear time-invariant filter with a substantially flat frequency response such as an all-pass filter. An output signal of the inverse excursion estimator 438 is applied to the input of the power amplifier 412 which generates an audio output signal at the audio output 416 of sufficient amplitude and power to drive the loudspeaker 414.

Figure 5A:
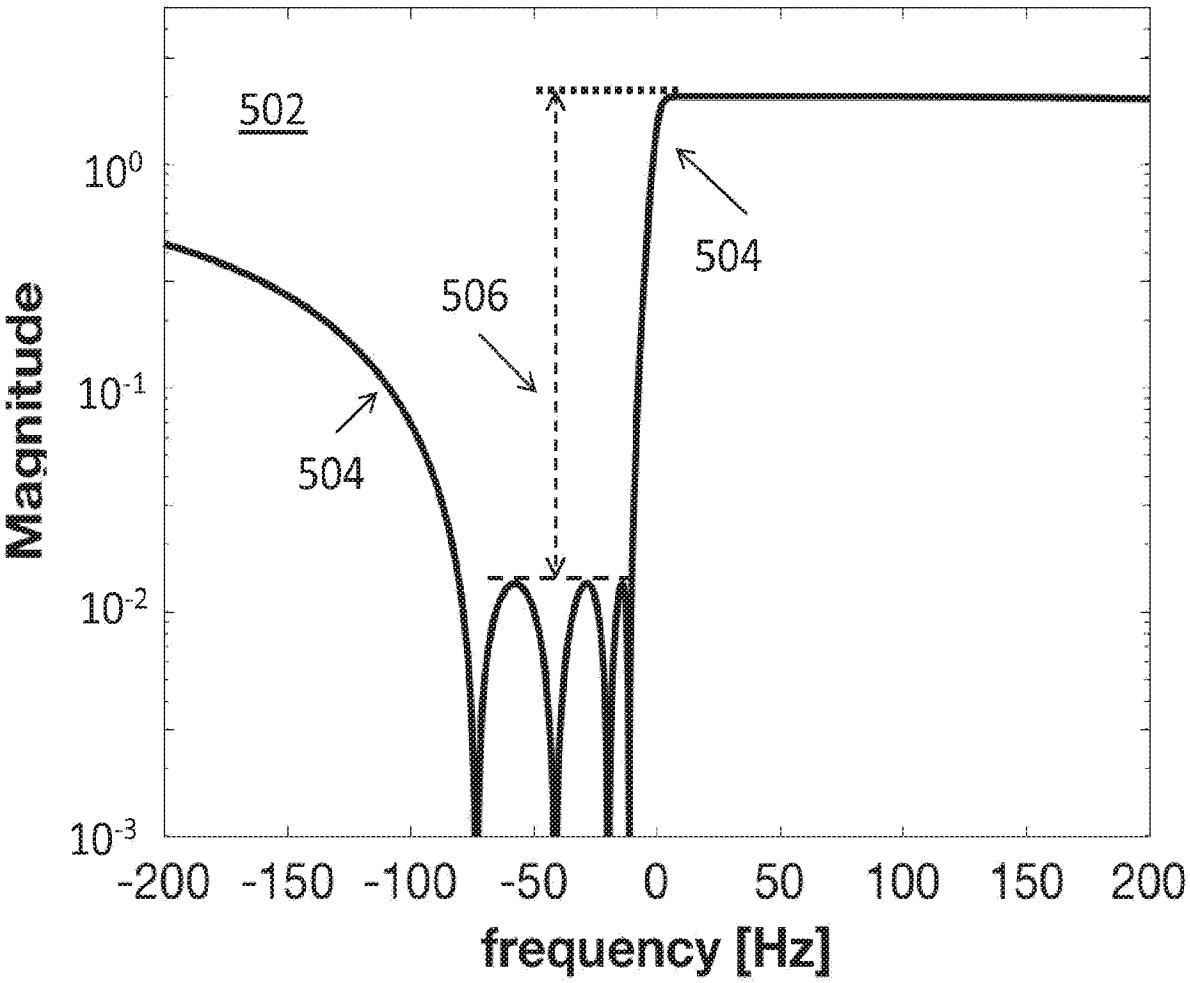
FIGS. 5A and 5B show a pair of frequency response plots for a pair of Hilbert transform all-pass filters.
Figure 5B:
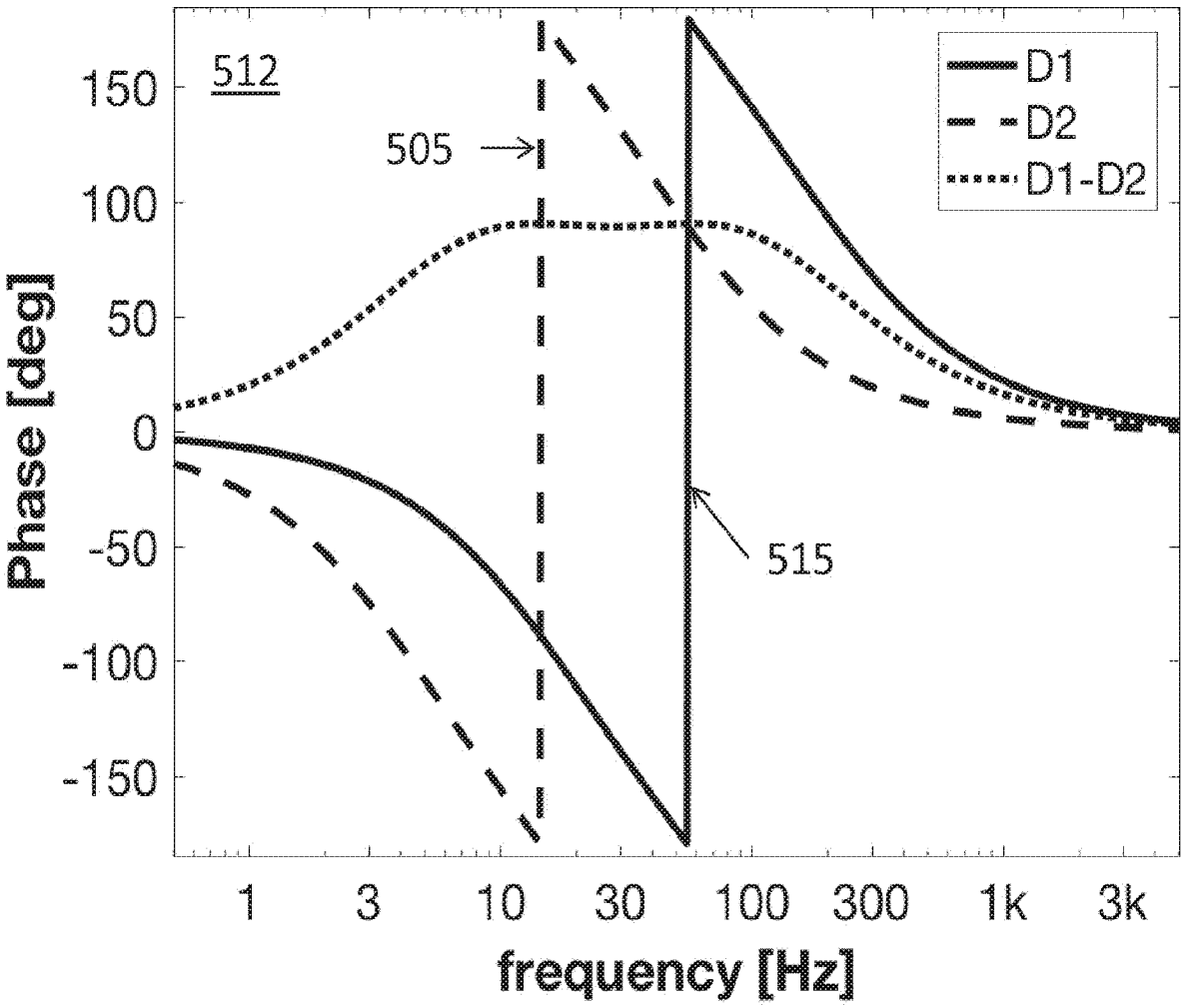

FIGS. 5A and 5B show frequency response plots 502, 512 for a pair all-pass filters tailored or adapted for estimating a Hilbert transformation of the excursion signal. As previously discussed, the first envelope detector 220, 420 may utilize the pair of all-pass filters for determining or estimating the excursion envelope of the excursion signal. The skilled person will appreciate that other embodiments of the invention may utilize different types of envelope detectors for estimating the excursion envelope—for example envelope detections based on rectification and lowpass filtering of the excursion signal. Each all-pass filter of the pair of all-pass filters possesses a substantially unity gain pass-band response in the frequency band of interest which may comprise the previously discussed target frequency band situated between e.g. 10 Hz and 80 Hz. The all-pass filters exhibit a mutual phase difference of substantially 90 degrees over the selected target frequency band for the present embodiment. This property is evident from the plotted phase responses 505, 515 of the first and second all-pass filters as depicted on graph 512. The phase difference plot 525 confirms that the mutual phase difference of the all-pass filter responses is close to 90 degrees, deviating less than +/−5 degrees, at least throughout the frequency range 10 Hz to 80 Hz. The respective signal outputs of the first and second all-pass filters may be treated as a 2-dimensional vector or a complex number. The 90 degree phase difference means that the magnitude calculated by the first magnitude estimator 224, 424 represents a good estimate of the squared envelope of the excursion signal.

Considering the pair of all-pass filters a complex linear filter has the consequence that the complex linear filter has a pass band at either positive or negative frequencies (depending on which filter is assigned to an imaginary channel Q) and a stop-band mirrored at the opposite polarity frequency band. The computed frequency response magnitude of the complex linear filter is shown on plot 504 of graph 502. Furthermore, the stop-band attenuation of the complex linear filter, as indicated by arrow 506, determines the amount of ripple on the detected excursion envelope. The ripple on the detected excursion envelope is preferably kept low to suppress pumping or modulation (which is distortion) of the processed audio signal outputted by the adjustable high-pass filter 208, 408. The frequency responses of the pair of all-pass filters have been carefully designed to exhibit large/high stop-band attenuation, approximately 40 dB as evidenced by plot 504. A preferred embodiment of the pair of all-pass filters, or complex linear filter, comprises a pair of carefully optimized 2nd order IIR filters (e.g. bi-quads). The inventors have discovered that such a pair of 2nd order IIR filters is able to produce an accurate approximation to the desired 90 degree mutual phase difference across a frequency band of at least 3 octaves, e.g. at least from 10 to 80 Hz. The pair of 2nd order IIR filters for implementation of the complex linear filter/Hilbert transform filter possesses numerous advantages for audio applications such as a low time delay and low computational complexity.

Figure 6:
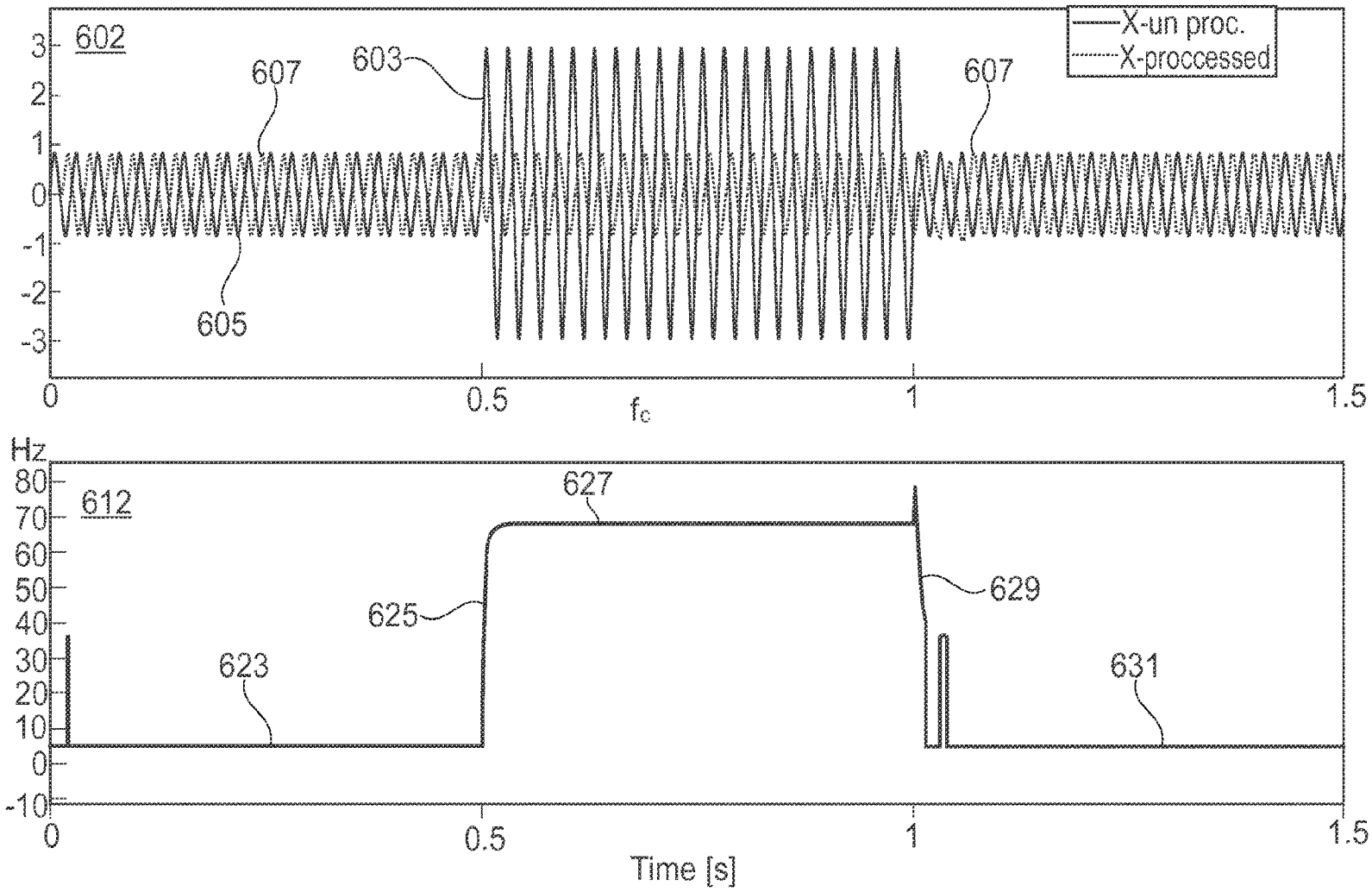
FIG. 6 shows a set of graphs with plots of various simulated signal variables and waveforms of a diagram excursion limiter in accordance with the second embodiment of the invention.

FIG. 6 shows two graphs 602, 612 depicting respective plots of simulated signal variables and waveforms of an exemplary diagram excursion limiter in accordance with the above-discussed second embodiment. The exemplary diagram excursion limiter is implemented in Simulink to extract the plotted signal variables and waveforms. The plots of the signal variables and waveforms illustrate the dynamic operation of the excursion limiter. As mentioned above, this second embodiment operates in the excursion domain where the excursion signal is inputted to the adjustable low-frequency suppressor 408 and the processed output signal likewise resides in the excursion domain until it is converted back to the voltage/amplitude domain by the inverse x>V function 438.

The y-axis of the upper graph 602 is plotted in arbitrary units while the x-axis shows time in seconds. The adjustable low-frequency suppressor 408 (on FIG. 4) is implemented as a sliding/adjustable 2nd order high-pass filter with a pre-set minimum cut-off frequency of 5 Hz. The value of the preset minimum cut-off frequency may be stored in the control circuit. A sine wave burst signal at 40 Hz is applied to the input of the ??? diagram excursion limiter for excitation of the diagram excursion limiter. The plot 605 in full line shows the excursion signal at the input of the adjustable low-frequency suppressor 408 (on FIG. 4). The signal plot 607 (broken line) shows the processed excursion signal at the output of the adjustable low-frequency suppressor. The excursion threshold is set to 1.0 such that the peak amplitude of the sinewave excursion signal 603 lies just below the excursion threshold from t=0 until t=0.5 s, i.e. before the burst occurrence at t=0.5 s. The amplitude of the excursion signal 605 jumps abruptly to an amplitude of about 3.0 at t=0.5 as evident from the signal plot. The amplitude of the excursion signal 605 reverts abruptly to the initial value just below 1.0 at t=1.0 s. Hence, the duration of the burst is approximately 0.5 s. The skilled person will understand that this burst signal may represent/simulate a low-frequency and high amplitude transient event of a typical audio signal.

The lower graph 612 shows a plot of the instantaneous cut-off frequency fc of the adjustable high-pass filter (408) illustrating the dynamic response of the adjustable high-pass filter. fc is depicted along the y-axis in Hz. When the amplitude of the excursion signal 605 lies just below the excursion threshold, e.g. from t=0 until t=0.5 s, the cut-off frequency fc of the adjustable high-pass filter is set to a constant minimum setting $f_{min}$ of 5 Hz as indicated by plot section 623. This feature is achieved by the previously discussed response of the controller to an excursion signal situated below the excursion threshold. The amplitude of the excursion signal 605 jumps abruptly at t=0.5 as discussed above, and illustrated by plot section 625, to a value markedly above the excursion threshold of 1.0. In response, the controller rapidly increases the cut-off frequency fc of the adjustable high-pass filter tracking the instantaneous computed acceleration envelope (not shown). This tracking leads the controller to adjust the cut-off frequency fc to approximately 68 Hz and maintain the latter fc value, essentially constant, for the duration of the burst event reflecting the now settled magnitude of the acceleration envelope.

When the amplitude of the excursion signal 605 reverts to the initial value just below 1.0 at t=1.0 s, the controller responds by decreasing the cut-off frequency fc of the adjustable high-pass filter to the minimum setting $f_{min}$ of 5 Hz as illustrated by plot sections 629 and 631. The impact on the processed excursion signal at the output of the adjustable high-pass filter by the burst event at t=0.5 s is illustrated by the signal plot 607 (broken line). While the amplitude of the excursion signal 605 jumps abruptly at t=0.5 as discussed above, the amplitude of the processed excursion signal 607 remains essentially constant, or even shows a slight decrease. Hence, the amplitude of the processed excursion signal remains well below the threshold of 1.0 which may reflect a maximum allowable excursion/excursion limit of the loudspeaker connected to the output of the present diagram excursion limiter. Hence, the maximum diaphragm excursion or displacement of the loudspeaker is effectively limited to a magnitude below the excursion limit keeping the loudspeaker within its???? safe operating area.

Figure 7:
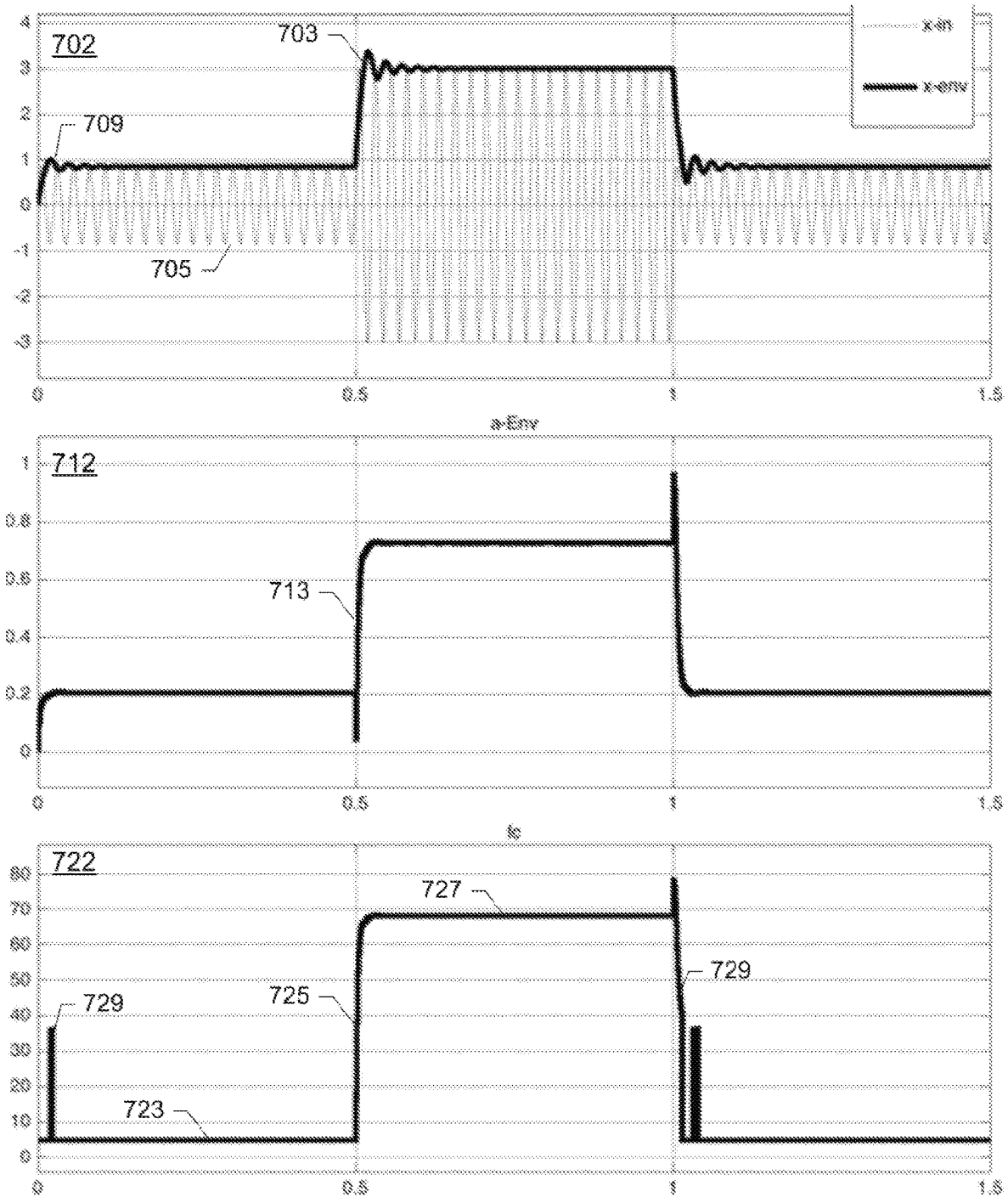
FIG. 7 shows a set of graphs with additional plots of simulated signal variables and waveforms of the diagram excursion limiter in accordance with the second embodiment of the invention.

FIG. 7 shows three additional graphs 702, 712, 722 depicting respective plots of various simulated signal variables and waveforms of the above-discussed exemplary diagram excursion limiter to gain further insight into the dynamic properties of the diagram excursion limiter. The plot 705 of graph 702 shows the excursion signal at the input of the adjustable low-frequency suppressor and plot 703 shows the computed corresponding excursion envelope. The excursion envelope exhibits minor magnitude ripples at the on-set and the termination of the excursion signal burst at t=0.5 s and t=1.0 s, respectively, probably caused by spectral sideband components of the sine wave burst signal induced by the square-wave like amplitude modulation of the 40 Hz sine wave. These spectral side-band components may lie outside the frequency range of the adjustable highpass filter and cause dynamic ripple in the time domain representation of the excursion envelope. The plot 713 of graph 712 shows the corresponding acceleration envelope. Finally, the plot of the lower-most graph 722 shows the corresponding instantaneous cut-off frequency fc of the adjustable high-pass filter as discussed above. The relationship between the instantaneous cut-off frequency fc and the acceleration envelope 713 is evident. The instantaneous cut-off frequency fc tracks the acceleration envelope 713 as soon as the excursion envelope exceeds the set threshold value of 1.0—this feature is for example illustrated by the short spike in the excursion envelope 709 which shortly exceeds the threshold value of 1.0. This spike therefore leads to a corresponding spike/response 729 of the instantaneous cut-off frequency fc.

The invention claimed is:

1. A method of controlling diaphragm excursion of an electrodynamic loudspeaker, comprising:

receiving a first audio signal;

deriving, by an excursion estimator, an excursion signal, representing diaphragm excursion of the electrodynamic loudspeaker, from the first audio signal;

deriving, by a first envelope detector, an excursion envelope from the excursion signal;

applying a second audio signal, derived from the first audio signal, to an input of an adjustable low-frequency suppressor; and filtering, by the adjustable low-frequency suppressor, the second audio signal to selectively attenuate low-frequency components based on the excursion envelope to produce a processed audio signal with reduced low-frequency content deriving an acceleration envelope, representing diaphragm acceleration of the electrodynamic loudspeaker, from the excursion signal or the excursion envelope;

said filtering step comprises filtering the second audio signal in accordance with the acceleration envelope; or determining an instantaneous frequency of the first audio signal, wherein said filtering step comprises filtering the second audio signal in accordance with the instantaneous frequency.

2. The method of claim 1, further comprising:

applying the excursion signal to the input of the adjustable low-frequency suppressor;

converting the processed audio signal into a corresponding audio voltage signal; and amplifying or buffering the corresponding audio voltage signal for application to the electrodynamic loudspeaker.

3. The method of claim 1, further comprising:

comparing the excursion envelope to an excursion threshold representing a predetermined excursion magnitude of a diaphragm of the electrodynamic loudspeaker; and maintaining a substantially stationary response of the adjustable low-frequency suppressor in response to a determination that the excursion envelope is smaller than the excursion threshold.

4. The method of claim 1, wherein the adjustable low-frequency suppressor includes an adjustable high-pass filter with an adjustable cut-off frequency.

5. The method of claim 4, further comprising:

setting the cut-off frequency of the adjustable high-pass filter to a predetermined minimum setting in response to a determination that the excursion envelope is smaller than an excursion threshold representing a predetermined excursion magnitude of a diaphragm of the electrodynamic loudspeaker.

6. The method of claim 5, further comprising:

increasing the adjustable cut-off frequency of the adjustable high-pass filter in response to increasing a magnitude of an acceleration envelope, representing diaphragm acceleration of the electrodynamic loudspeaker, in response to a determination that the excursion envelope exceeds the excursion threshold.

7. The method of claim 6, further comprising:

determining the adjustable cut-off frequency, fc, of the adjustable high-pass filter according to $$f_c = \sqrt{\frac{A_{acc}}{X_{th}}}$$

wherein:

$A_{acc}$ represents an instantaneous acceleration envelope;

$X_{th}$ represents the excursion threshold.

8. The method of claim 4, wherein the deriving of the excursion envelope of the excursion signal includes determining a Hilbert transform of the excursion signal.

9. The method of claim 8, wherein the determining the Hilbert transform of the excursion signal includes filtering the excursion signal with a first all-pass filter exhibiting a first phase response, and filtering the excursion signal with a second all-pass filter exhibiting a second phase response wherein the first and second all-pass filters exhibit a mutual phase difference of substantially 90 degrees over a predetermined frequency range of the first audio signal.

10. The method of claim 1, wherein the deriving the acceleration envelope includes filtering the excursion envelope by a 2nd order high-pass filter possessing a predetermined high-pass cut-off frequency, and the predetermined high-pass cut-off frequency is situated at or above a maximum cutoff frequency of an adjustable high-pass filter.

11. The method of claim 2, further comprising:

Applying the amplified or buffered corresponding audio voltage signal to the electrodynamic loudspeaker.

12. The method of claim 3, wherein the predetermined excursion magnitude of the diaphragm of the electrodynamic loudspeaker is a maximum diaphragm excursion.

13. The method of claim 9, wherein the predetermined frequency range of the first audio signal is between minimum and maximum settings of the adjustable cut-off frequency of the adjustable high-pass filter.

14. A diaphragm excursion limiter for a loudspeaker, the diaphragm excursion limiter comprising:

an audio signal path extending between an audio input and an audio output, said audio input configured for receipt of a first audio signal;

said audio signal path comprising at least an adjustable low-frequency suppressor for receipt and filtering of a second audio signal, derived from the first audio signal;

an excursion estimator configured for determining an excursion signal, representing diaphragm excursion of the loudspeaker, based on the first audio signal;

a first envelope detector configured for determining an excursion envelope of the excursion signal; and a controller configured to adjust a frequency response of the adjustable low-frequency suppressor based on the excursion envelope to selectively suppress low-frequency components of the second audio signal in a processed audio signal at an output of the adjustable low-frequency suppressor said diaphragm excursion limiter further comprising a second envelope detector configured for determining an acceleration envelope, representing diaphragm acceleration of the loudspeaker, based on the excursion signal or the excursion envelope;

said controller is configured to adjust the frequency response of the adjustable low-frequency suppressor in accordance with the acceleration envelope; or said suppressor is configured to determine an instantaneous frequency of the first audio signal.

15. The diaphragm excursion limiter according to claim 14, wherein the controller includes a comparator configured to compare the excursion envelope to an excursion threshold representing a predetermined excursion value of the diaphragm, wherein the controller is configured to a substantially stationary frequency response of the adjustable low-frequency suppressor in response to a determination that the excursion envelope is smaller than the excursion threshold, and the frequency response of the adjustable low-frequency suppressor to increase attenuation of the low-frequency components of the second audio signal for increasing acceleration envelope in response to a determination that the excursion envelope exceeds the excursion threshold.

16. The diaphragm excursion limiter according to claim 15, wherein the predetermined excursion value of the diaphragm is a maximum diaphragm excursion.

17. A diaphragm excursion control system, comprising:

the diaphragm excursion limiter according to claim 13; and a loudspeaker, the loudspeaker configures to receive the processed audio signal supplied by the diaphragm excursion limiter for diaphragm excursion or displacement limitation, the loudspeaker configures to receive the processed audio signal through a power amplifier of the diaphragm excursion limiter.

* * * * *